US008636604B2

(12) United States Patent
Beach et al.

(10) Patent No.: US 8,636,604 B2
(45) Date of Patent: Jan. 28, 2014

(54) ROTATING/SWIVELING GOLF CLUB HEAD TRAINING AID

(71) Applicants: Bryce Beach, Hastings, PA (US); Victor Beach, Hastings, PA (US); Justin Beach, Hastings, PA (US); Scott Strittmatter, Edensburg, PA (US)

(72) Inventors: Bryce Beach, Hastings, PA (US); Victor Beach, Hastings, PA (US); Justin Beach, Hastings, PA (US); Scott Strittmatter, Edensburg, PA (US)

(73) Assignee: The B Group Products, LLC, Hastings, PA (US)

( * ) Notice: Subject to any disclaimer, the term of this patent is extended or adjusted under 35 U.S.C. 154(b) by 0 days.

(21) Appl. No.: 13/742,936

(22) Filed: Jan. 16, 2013

(65) Prior Publication Data

US 2013/0190099 A1 Jul. 25, 2013

Related U.S. Application Data

(60) Provisional application No. 61/588,960, filed on Jan. 20, 2012.

(51) Int. Cl.

| | |
|---|---|
| ***A63B 69/36*** | (2006.01) |
| ***A63B 53/02*** | (2006.01) |
| ***A63B 53/10*** | (2006.01) |

(52) U.S. Cl.

USPC ..... 473/226; 473/307

(58) Field of Classification Search

USPC ..... 473/219, 226, 231, 238, 257, 288, 299, 473/307, 309, 314, 409

See application file for complete search history.

(56) References Cited

U.S. PATENT DOCUMENTS

| | | | | |
|---|---|---|---|---|
| 1,613,360 | A * | 1/1927 | Rigby | 473/296 |
| 6,547,673 | B2 * | 4/2003 | Roark | 473/239 |
| 7,775,902 | B2 * | 8/2010 | Churovich | 473/296 |
| 7,955,184 | B2 * | 6/2011 | Stites et al. | 473/288 |
| 8,210,964 | B2 * | 7/2012 | Horne | 473/282 |
| 8,425,345 | B2 * | 4/2013 | Wall et al. | 473/296 |
| 2010/0069170 | A1 * | 3/2010 | Bennett et al. | 473/288 |

* cited by examiner

*Primary Examiner* — Nini Legesse
(74) *Attorney, Agent, or Firm* — David G. Oberdick

(57) ABSTRACT

A golf club training aid for improving a golf swing, with the golf club including a club head, a club shaft attached to the club head that rotates within the club head, a stop that limits the rotational range of the club shaft in respect to the club head, and a tension actuator that attaches to the club shaft and club head and provides tension against the rotation of the club head about the club shaft. The tension provided by the tension actuator is overcome when the club shaft is rotated, by proper hand rotation, during a club swing to create a rotational force greater than the tension force, whereby the club head rotates to a rest position—the end of the rotational range of the stop—and the club face makes solid contact with a golf ball. If proper hand rotation does not occur during a swing, the club head and stop will remain in an open position upon contact with a golf ball and the club head will, at that point of contact, move backward and result in angled contact with a golf ball during the golf swing.

15 Claims, 6 Drawing Sheets

ROTATING/SWIVELING GOLF CLUB HEAD TRAINING AID

CROSS REFERENCE TO RELATED APPLICATIONS

The present invention claims benefit of U.S. Provisional Application Ser. No. 61/588,960, entitled "The Turn—Rotating/Swiveling Golf Club Head Training Aid" filed on Jan. 20, 2012, which is incorporated herein by reference.

FIELD OF THE INVENTION

The invention pertains to the field of golf clubs. More particularly, the invention pertains to a golf club that is used as a training aid for a golf swing and a method for making and using the golf club.

BACKGROUND OF THE INVENTION

Within the golf industry there are various training aids and materials to help new and even experienced golfers improve their golf swing and/or who are looking to have a better, more consistent golf swing.

The invention differs from any previous training aid because it is designed to help the average player of golf physically "turn over" his/her hands through the impact zone of the golf swing, that is, when the golf club is in contact with the golf ball. If a player's hands are not physically turned during such contact, the force of impact resulting from contact between the club head and the ball will cause the tension-assisted or tension-actuated club head of the present invention to rotate backward or "open"—and thereby cause an over-exaggerated "slice" in the flight of the golf ball. The training aid of the present invention is differentiated from other training aids because it feels like a "real" golf club when hitting golf balls, and the tension assisted rotating head can be adjusted for different club swing speeds. As a result, the user of the training aid of the present invention gets to physically see/feel what he/she needs to do in order to hit a ball correctly and straight, and, when switching from the training aid to their real clubs, the player feels as if nothing has changed—thus greatly improving the player's golf game.

FIGURES

Figure 3:
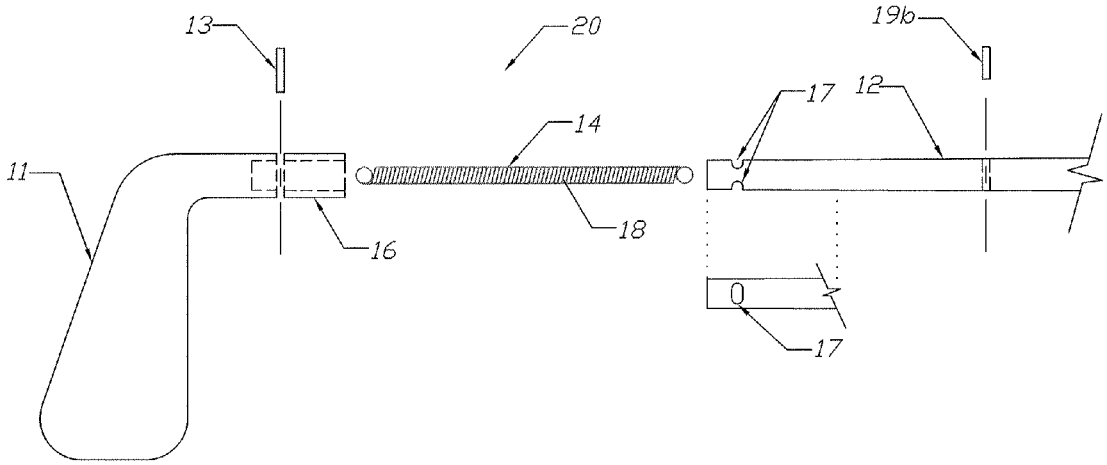
FIG. 3 shows a side assembly view of another embodiment of the golf club of the present invention.
Figure 5A:
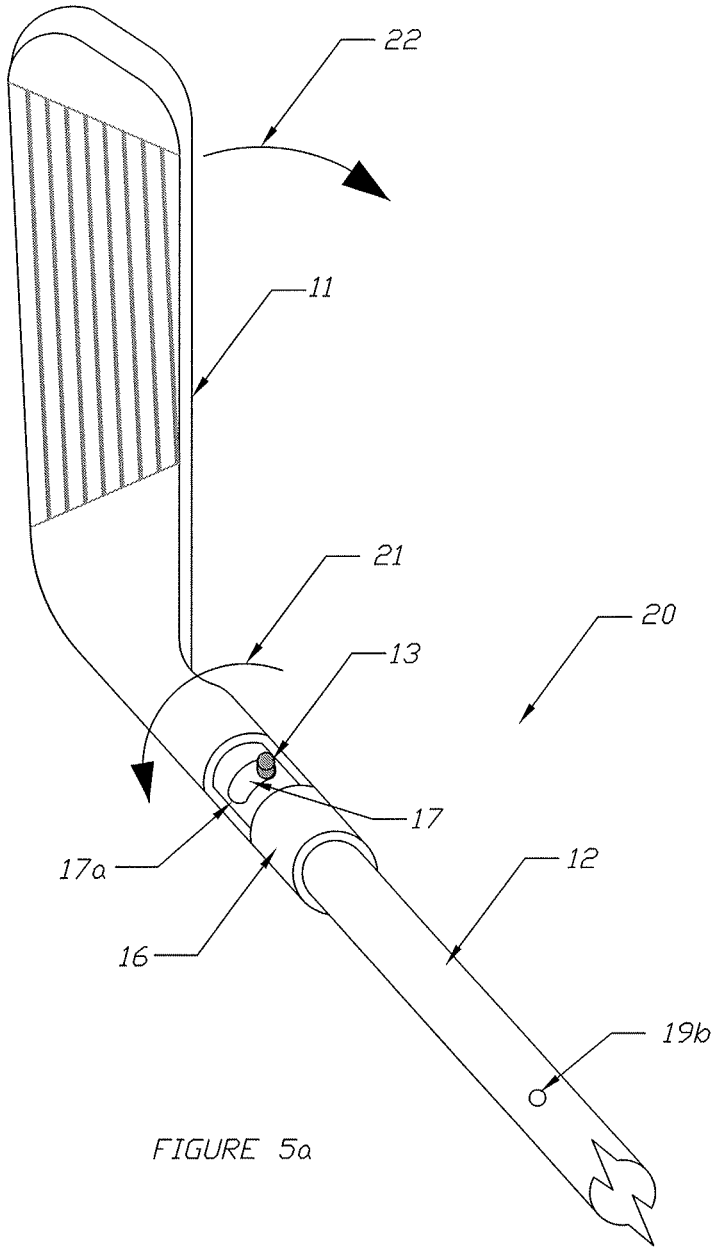

FIG. 5*a* shows a top isometric view of the embodiment of the golf club of the present invention shown in FIG. 3, with the stop and club face in the rest position.

Figure 5B:
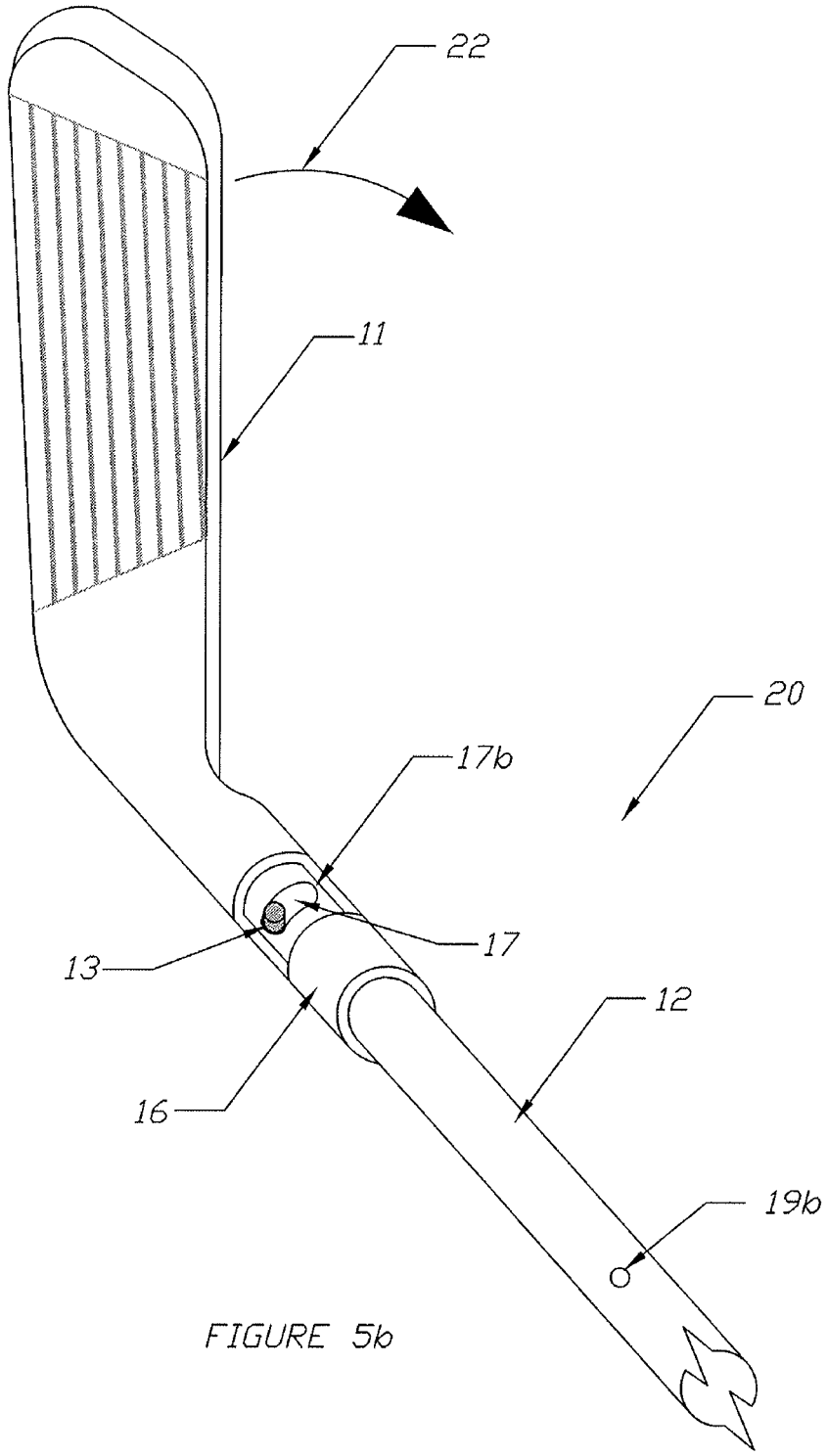

FIG. 5*b* a top isometric view of the embodiment of the golf club of the present invention shown in FIG. 3, with the stop and club face in the open position.

DETAILED DESCRIPTION OF THE INVENTION

The invention idea is a tension-assisted or tension-actuated rotating golf club head which rotates to an "open" position if the user fails to turn over his or her hands through impact of the ball. More specifically, under tension through contact with a golf ball in a golf swing, the club head rotates from the standard position to a designated "open" position if the user's hands fail to turn over during the process when the club head contacts a golf ball. However, if a user's hands turn over through the impact position—that is, the position in a swing where the club face contacts the golf ball—the rotational force imparted by the hand turn over overcomes the tension force against the club head and forces the club head to a fixed or stopping point when the club face meets a golf ball.

Designed to improve a person's golf game, the golf club of the present invention and the associated method of use helps to change a person's swing without having to use "weighted" or "varied flex" clubs. The present invention maintains the same integrity of a normal club in terms of shaft flex, swing weight, and total weight, making it easier for the user to switch from the training aid to his or her regular clubs without changing the user's golf swing.

In use, and upon impact of the ball while using the golf club of the present invention, the tension-actuated club head will rotate and flare "open" if the user fails to turn over his/her hands. While normally the user would experience a "fade" or even a "slice" by failing to turn over his or her hands with a regular club, use of the present invention—without proper turnover of the hands—will result in a "shank" or an over-exaggerated "slice" as described more fully below.

To prevent the "shank" and have a golf ball fly straight—while using the golf club of the present invention—a player must learn to turn over his or her hands during a downward golf swing and thereby provide a rotational force to the golf shaft. Once the swing has started through the impact zone, and the user's hands begin to turn over, the rotational force in the shaft overcomes the tension force that pushes the club head forward toward the golf ball, and the club head rotates backward to a fixed or stop so that, as contact with the golf ball is made, the club head position remains fixed during the remainder of the swing. After use and practice with the present invention, a player can switch back to his/her normal clubs, and the "fade" or "slice" should be eliminated or noticeably less evident—and will be replaced with the always anticipated "draw."

Figure 1:
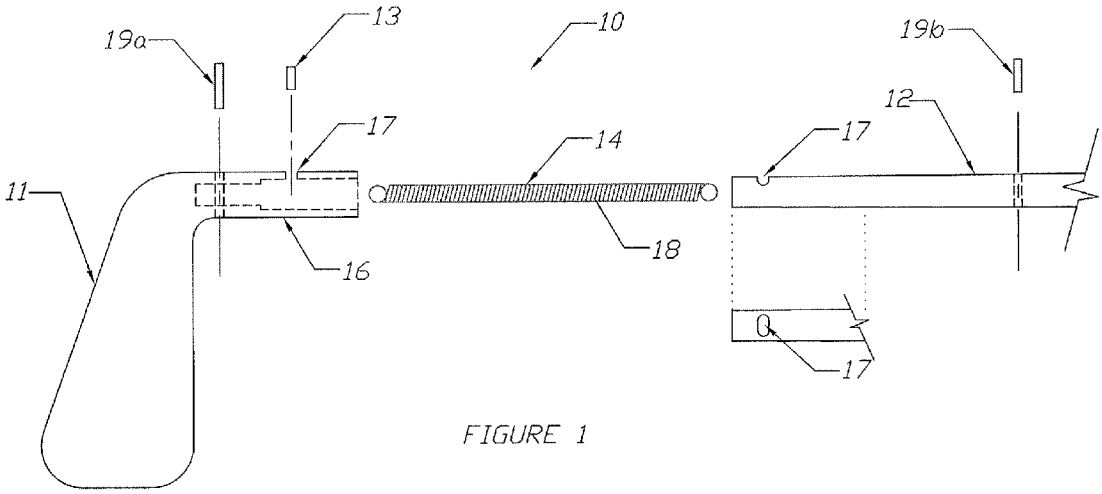
FIG. 1 shows a side assembly view of one embodiment of the golf club of the present invention.
Figure 2:
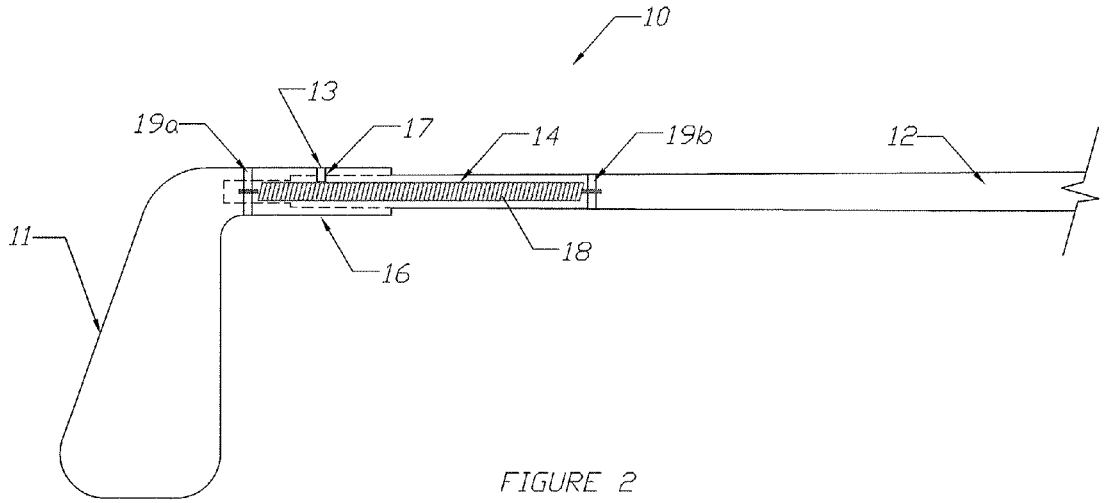
FIG. 2 shows a side cross-sectional view of one embodiment of the golf club of the present invention.

Referring to FIGS. 1 and 2, one embodiment of the golf club 10 of the present invention includes a club head 11 that attaches to club shaft 12 in a manner such that club head 11 can rotate about club shaft 12 (or vice-versa), a stop 13 that acts to define, i.e., stop the range of rotation of the club head 11 in respect to the shaft 12 and a tension actuator 14 that provides tension against the rotation of the club head 11. Such tension pushes the club head 11 to a "rest" position such that the club head 11 does not rotate or "open" except (i) when the club shaft 12 is rotated during a golf swing to create a rotational force greater than the tension force against the club head 11 and thereby push the club head 11 toward the end of the rotational range of the club head 11 before contact with a golf ball is made, or (ii) upon contact with a golf ball.

In the embodiment of the invention shown in FIGS. 1 and 2, stop 13 preferably is a pin, rod or other dowel-like insert that is comprised of a rigid material. Stop 13 can have a varied cross-sectional shape, i.e., it can have a round, oval, rectangular or other geometric shape. The external surface of stop 13 preferably is smooth, but it can be rough or threaded to form a partial or full screw. Stop 13 is inserted into the hosel 16 of club head 11 and extends into a notch 17 in the club shaft 12 that runs lengthwise in a direction that is substantially perpendicular to the axis of shaft 12. More specifically, in the embodiment of the invention shown in FIGS. 1 and 2, notch 17 preferably is about ¼ inches to ⅜ inches in length, with such length perpendicular in orientation to the vertical axis of the shaft 12. At rest, the tension actuator 15 pushes the front end of notch 17 into stop 13. For a right-handed golf club, this is the end of notch 17 that lies to the left as one looks downward along the vertical axis of club shaft 12. This orientation would be reversed for a left-handed club (i.e., the front end of notch 17 would lie to the right as one looks downward along the vertical axis of shaft 12). The length of notch 17 (which can vary) defines and limits the range of rotation of club head 11 about shaft 12. More specifically, the rotation of the club head 11 stops when stop 13 meets the back of the notch 17 (for a right-handed club, this is the end of notch 17 that lies to right as one looks downward along the vertical axis of club shaft 12). When a player uses a proper swing—that is, when the player's hands turn over during a swing before club head 11 contacts a golf ball—the user's action of quickly turning over his or her hands during the downward swing and before contact with a golf ball causes shaft 12 to rotate within the hosel 16 until the stop 13 in the hosel 16 of the club head 11 moves within and contacts the back end of notch 17 in the shaft 12. In an alternative embodiment (not shown), the hosel can rotate within the shaft. In effect, the turnover of hands imparts a rotational force to shaft 12 that overcomes the tension force the pushes the club head 11 to a rest position. When this "turn over" action is completed—and before the club head 11 contacts a golf ball—stop 13 is already at the back of the notch 17 (i.e., club head 11 has already fully opened through its range of rotation), and club head 11 can rotate no further such that it remains fixed when contact is made with a golf ball. Other stopping devices or mechanisms that accomplish the same function can also be used as part of this invention.

If a player does not turn over his or her hands during the downward golf swing, such that there is no rotation of shaft 12 in respect to club head 11 before contact with a golf ball is made, stop 13 will not be at the back end of notch 17, and the force imparted to the face of club head 11 from contact with the golf ball will cause club head 11 to "open", that is rotate backward from the forward direction of the swing, such that the face of club head 11 becomes angled during contact with a golf ball and the ball will slice or shank as described above. This same action will occur as the result of a slow golf swing and slow rotation of the hands such that the rotational force cause by the turn over of hands on the grip of shaft 12 does not overcome the tension force that pushes the front of notch 17 into stop 13.

As shown in the embodiment of the invention shown in FIGS. 1 and 2, tension actuator 14 can be comprised of a spring 18 which is attached to the club head 11 and club shaft 12 by supports 19*a* and 19*b*, which, like stop 13, are rigid pins, rods or other dowel-like members that are inserted into club head 11 and club shaft 12, respectively, and that hold or support the ends of tension actuator 14. In other embodiments of the invention, the tension actuator 14 can include other mechanisms or devices, of varying compositions, that are suitable for placement within a club head 11 and shaft 12 and that rotational elasticity so as to provide tension against the rotation of club head 11 on shaft 12, including, by way of example but not limitation, springs of varying shape, size and orientation; coils; elastic, flexible or twistable straps or strips; and belts.

In the embodiment of the invention shown in FIGS. 1 and 2, the tension actuator 14 can be adjusted by rotationally turning spring 18 to increase or decrease the tension in spring 18. Such adjustment is helpful in adapting the golf club 10 of the present invention for use by players with differing levels of force in their respective swings. Tension adjustment is also helpful for different speeds of hand turn over and shaft rotation speed. Turning over the hands slowly would require a looser or less tension adjustment, turning over the hands faster would require a tighter or stronger tension adjustment.

Other adjustment mechanisms can be used in other embodiments, including adjustment mechanisms located on the external portions of club head A and/or club shaft E.

Figure 4:
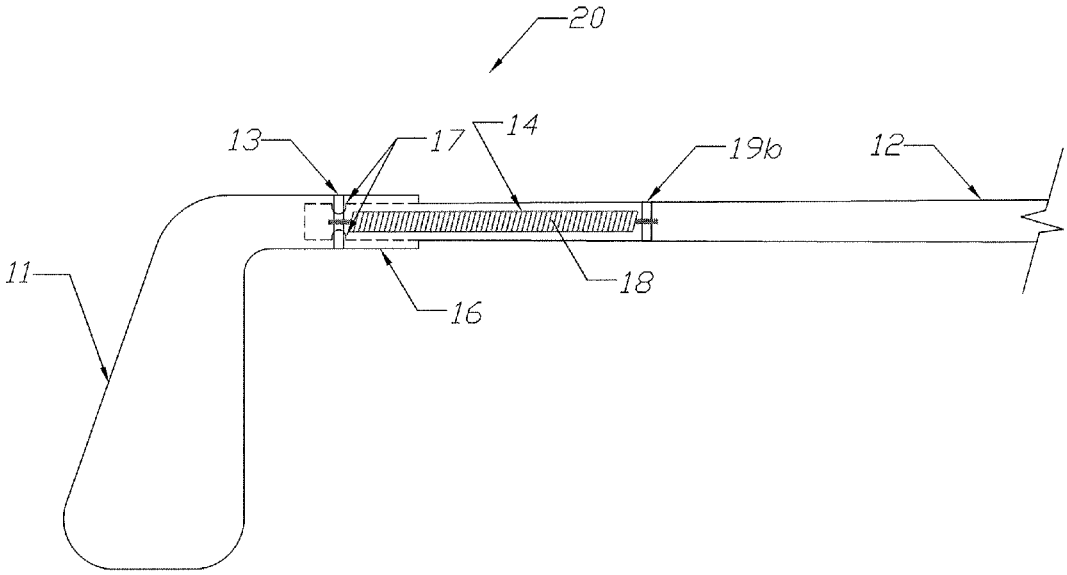
FIG. 4 shows a side cross-sectional view of another embodiment of the golf club of the present invention.

FIGS. 3, 4, 5*a* and 5*b* show another embodiment of the present invention. Specifically, golf club 20 is shown in FIGS. 3 and 4, with golf club 20 having many of the same components as golf club 10 in FIGS. 1 and 2 (similar components have the same numerical references in FIGS. 1-4). Golf club 20 differs, though, in that stop 13 also serves as the tension actuator support in club head 11. More specifically, support 19*b* remains in golf club 20, but stop 13 serves two purposes and takes the place of support 19*a* shown in FIGS. 1 and 2. In this capacity, notch 17 is made on opposite sides of club shaft 12 as shown in FIG. 3. In all other respects, the function of golf club 20 is like that of club golf 10.

FIGS. 5*a* and 5*b*, in particular, show the movement of stop 13 and club head 11 in respect to shaft 12. In FIG. 5*a*, stop 13 and club head 11 are in a rest position Internally, as shown in FIG. 3, tension actuator 14 pushes stop 13 against the front edge 17*a* of slot 17. In FIG. 5B, stop 13 and club head 11 are in an open position, whereby stop 13 is against the back edge 17*b* of slot 17. Stop 13 is pushed backward against the back edge 17*b* of slot 17 by one of two actions during a golf swing If shaft 12 rotates forward rotationally in the manner shown by arrow 21, stop 13 and club head 11 will rotate backward as shown by arrow 22, until stop 13 contacts back edge 17*b* of slot 17. If this rotation occurs before contact with a golf ball, club head 11 will have solid contact with a golf ball (i.e., the place of the club face will be substantially perpendicular to the desired flight of the golf ball). If the backward rotation of stop 13 and club head 11 does not occur before contact with a golf ball, the contact with golf ball will cause such backward rotation (as shown in FIG. 5*b*), and the plane of the club face will be angled in respect to the desired flight of the golf ball.

Golf clubs 10 and 20 of the present invention can be constructed as a new club, or, alternatively, it can be retrofitted into an existing club. In the latter instance, the club head 11 of an existing club is removed from the shaft 12 and the tension actuator 14 is inserted into and attached to club head 11 and shaft 12 as shown, by way of example, in FIGS. 1 and 3. More specifically, holes for supports 19*a* and 19*b*, as applicable, and stop 13 are drilled into an existing club head 11 and shaft 12 to allow for implementation of these elements of the stop and tension actuator mechanisms shown in FIGS. 1 and 3. Similarly, notch 17 can be retrofitted into hosel 16. The club head 11 and shaft 12 are then reattached. Accordingly, the present invention includes the method of retrofitting an existing club to include a tension actuator and club rotation stop mechanisms.

In addition, the present invention includes the method of using the golf club of the present invention to teach an individual to improve his or her swing in the manner described above. In particular, the golf club of the present invention is used to teach a user how to use proper hand rotation as part of a golf swing. As described previously, to prevent the "shank" of a golf ball and, instead, to have a golf ball fly straight—while using the golf club of the present invention—a player must learn to turn over his or her hands during a downward golf swing and thereby provide a rotational force to the golf shaft. Once the swing has started through the impact zone, and the user's hands begin to turn over, the rotational force in the shaft 12 overcomes the tension force provided by tension actuator 14 and that pushes the club head 11 forward toward the golf ball, and the club head 11 rotates backward to a fixed or stop so that, as contact with the golf ball is made, the club head 11 position remains fixed during the remainder of the swing. After use and practice with the present invention, a player can switch back to his/her normal clubs, and the "fade" or "slice" should be eliminated or noticeably less evident—and will be replaced with the always anticipated "draw."

The invention is described above in relation to two preferred embodiment and implementation thereof which is exemplary in nature and descriptively specific as disclosed. As is customary, it will be understood that no limitation of the scope of the invention is thereby intended. The invention encompasses such alterations and further modifications in the illustrated apparatus, and such further applications of the principles of the invention illustrated herein, as would normally occur to persons skilled in the art to which the invention relates.

What is claimed is:

1. A golf club for improving a golf swing, such golf club consisting of:

a. a club head;

b. a club shaft attached to the club head and that rotates within the club head;

c. a stop that limits the rotational range of the club shaft in respect to the club head; and d. a tension actuator that attaches to the club shaft and club head and provides tension against the rotation of the club head about the club shaft except when either (i) the club shaft is rotated during a club swing to create a rotational force greater than the tension force that pushes the club head to a rest position, and thereby forces the club head to rotate to the end of the rotational range of the stop in the club head before contact with a golf ball is made, or (ii) upon contact with a golf ball.

2. The golf club of claim 1, wherein the tension actuator mechanism comprises a spring that attaches within the club head and club shaft.

3. The golf club of claim 1, wherein the tension actuator mechanism is selected from the group consisting of springs, coils, straps, strips and belts.

4. The golf club of claim 1, wherein the stop is comprised of a pin, rod, screw or other dowel-like member that is inserted into the hosel of the club head and that extends into a pre-cut notch in the club shaft, with the notch being substantially perpendicular to the axis of the shaft, such that the ends of the notch define the rotational range of the stop in the club head.

5. The golf club of claim 1, wherein the club head rotates within the shaft.

6. A method for retrofitting a golf club to a golf swing training aid, said method comprising the steps of:

a. separating the club head from the club shaft;

b. inserting and attaching a stop and tension actuator within the club shaft and club head, and reattaching the club shaft and club head such that:

i. the club shaft rotates within the club head;

ii. the stop that limits the rotational range of the club shaft in respect to the club head; and iii. the tension actuator provides tension against the rotation of the club head about the club shaft except when either (1) the club shaft is rotated during a club swing to create a rotational force greater than the tension force that pushes the club head to a rest position and forces the club head to rotate to the end of the rotational range of the stop in the club head before contact with a golf ball is made, or (2) upon contact with a golf ball.

7. The golf club of claim 6, wherein the tension actuator mechanism comprises a spring that attaches within the club head and club shaft.

8. The golf club of claim 6, wherein the tension actuator mechanism is selected from the group consisting of springs, coils, straps, strips and belts.

9. The golf club of claim 6, wherein the stop is comprised of a pin, rod, screw or other dowel-like member that is inserted into the hosel of the club head and that extends into a pre-cut notch in the club shaft, with the notch being substantially perpendicular to the axis of the shaft, such that the ends of the notch define the rotational range of the stop in the club head.

10. The golf club of claim 6, wherein the club head rotates within the shaft.

11. A method for improving a user's golf swing, said method consisting of the steps of a. using a golf club to strike a golf ball, said golf club consisting of:

i. a club head;

ii. a club shaft attached to the club head and that within the club head;

iii. a stop that limits the rotational range of the club shaft in respect to the club head; and iv. a tension actuator that attaches to the club shaft and club head and provides tension against the rotation of the club head about the club shaft except when either (1) the club shaft is rotated during a club swing to create a rotational force greater than the tension force that pushes the club head to a rest position and forces the club head to rotate to the end of the rotational range of the club head before contact with a golf ball is made, or (2) upon contact with a golf ball; and b. adjusting the rotation of the user's hands during the golf swing so that, prior to contact with a golf ball, the club shaft is rotated during a club swing to create a rotational force greater than the tension force and push the club head to the end of the rotational range of the club head.

12. The golf club of claim 11, wherein the tension actuator mechanism comprises a spring that attaches within the club head and club shaft.

13. The golf club of claim 11, wherein the tension actuator mechanism is selected from the group consisting of springs, coils, straps, strips and belts.

14. The golf club of claim 11, wherein the stop is comprised of a pin, rod, screw or other dowel-like member that is inserted into the hosel of the club head and that extends into a pre-cut notch in the club shaft, with the notch being substantially perpendicular to the axis of the shaft, such that the ends of the notch define the rotational range of the stop in the club head.

15. The golf club of claim 11, wherein the club head rotates within the shaft.

* * * * *